US008727810B2

(12) United States Patent
Yoshida et al.

(10) Patent No.: US 8,727,810 B2
(45) Date of Patent: May 20, 2014

(54) CONNECTOR

(75) Inventors: Takushi Yoshida, Tokyo (JP); Hiroshi Akimoto, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 44 days.

(21) Appl. No.: 13/534,434

(22) Filed: Jun. 27, 2012

(65) Prior Publication Data

US 2013/0005188 A1 Jan. 3, 2013

(30) Foreign Application Priority Data

Jun. 30, 2011 (JP) ..... 2011-146352

(51) Int. Cl.
*H01R 24/00* (2011.01)

(52) U.S. Cl.
USPC ..... 439/630; 439/862

(58) Field of Classification Search
USPC ..... 439/886, 66, 862, 630
See application file for complete search history.

(56) References Cited

U.S. PATENT DOCUMENTS 3,864,004 A * 2/1975 Friend ..... 439/844
3,989,331 A * 11/1976 Hanlon ..... 439/70
4,722,470 A * 2/1988 Johary ..... 228/180.21
4,948,030 A * 8/1990 Chason et al. ..... 228/118
5,334,422 A * 8/1994 Myers et al. ..... 427/552
5,367,124 A * 11/1994 Hoffman et al. ..... 174/552
5,453,017 A * 9/1995 Belopolsky ..... 439/83
5,934,951 A * 8/1999 Lai et al. ..... 439/876
5,957,736 A * 9/1999 Moriuchi et al. ..... 439/876
6,086,426 A * 7/2000 Chang ..... 439/630
6,268,017 B1 * 7/2001 Takeuchi et al. ..... 427/125
6,290,555 B1 * 9/2001 Nubuyuki et al. ..... 439/876
6,338,634 B1 * 1/2002 Yu ..... 439/83
6,354,891 B1 * 3/2002 Schnell et al. ..... 439/862
6,454,607 B2 * 9/2002 Bricaud ..... 439/630
7,080,451 B2 * 7/2006 Saito et al. ..... 29/874
7,172,438 B2 * 2/2007 Vicich et al. ..... 439/83
7,195,498 B1 * 3/2007 Wang et al. ..... 439/83
7,377,795 B2 * 5/2008 Vicich et al. ..... 439/83
7,625,244 B2 * 12/2009 Midorikawa ..... 439/660
8,129,227 B2 * 3/2012 Tellkamp ..... 438/123
8,235,733 B2 * 8/2012 Yamashiro et al. ..... 439/83
8,294,063 B2 * 10/2012 Miki et al. ..... 219/121.85
8,454,397 B2 * 6/2013 Nishi et al. ..... 439/876
8,479,390 B2 * 7/2013 Ohnishi et al. ..... 29/878

(Continued)

FOREIGN PATENT DOCUMENTS

JP 10-22035 A 1/1998

*Primary Examiner* — Ross Gushi
(74) *Attorney, Agent, or Firm* — Holtz, Holtz, Goodman & Chick, PC

(57) ABSTRACT

A connector which is capable of preventing spring characteristics of contacts from changing due to sucking up of solder. A plurality of contacts each include a contact portion in contact with an electrode of a card-type electronic component, a spring portion for pressing the contact portion against the electrode of the card-type electronic component, and a connection portion which is soldered to a pad on a printed substrate. The spring portion of each contact is formed with a low wettability area on an end thereof toward the connection portion, to which solder is less likely to adhere.

18 Claims, 11 Drawing Sheets

(56) References Cited

U.S. PATENT DOCUMENTS

| | | | | |
|---|---|---|---|---|
| 2001/0049231 | A1* | 12/2001 | Bricaud | 439/630 |
| 2002/0187688 | A1* | 12/2002 | Marvin et al. | 439/862 |
| 2004/0224541 | A1* | 11/2004 | Kato et al. | 439/83 |
| 2005/0103761 | A1* | 5/2005 | Miki et al. | 219/121.69 |
| 2006/0196857 | A1* | 9/2006 | Vicich et al. | 219/121.69 |
| 2006/0199447 | A1* | 9/2006 | Vicich et al. | 439/884 |
| 2007/0093146 | A1* | 4/2007 | Vicich et al. | 439/876 |
| 2009/0149088 | A1* | 6/2009 | Moriuchi et al. | 439/874 |
| 2011/0189898 | A1* | 8/2011 | Ju | 439/660 |
| 2012/0100758 | A1* | 4/2012 | Liaw et al. | 439/660 |
| 2013/0164982 | A1* | 6/2013 | Zhang et al. | 439/607.46 |

* cited by examiner

CONNECTOR

BACKGROUND OF THE INVENTION

1. Field of the Invention

The present invention relates to a connector.

2. Description of the Related Art

Conventionally, as shown in FIG. 9, there has been proposed a connector terminal unit 905 comprising a plurality of connector terminals 904 and an insulating tape 906 that connects these connector terminals 904 (see Japanese Laid-Open Patent Publication (Kokai) No. H10-22035, Paragraphs 0031, 0032, and 0037; FIGS. 5, 6, and 7). Note that FIGS. 9, 10, 11A, 11B, and 11C correspond to FIGS. 5, 6, 7(a), (b), and (c) in Japanese Laid-Open Patent Publication (Kokai) No. H10-22035, respectively.

As shown in FIGS. 10, 11A, 11B, and 11C, the connector terminals 904 are each configured such that there are continuously formed a flat bottom portion 941 that is in contact with a printed substrate 910, and an U-shaped contact portion 942 that is bent back from a front end of the bottom portion 941 such that it is curved upward.

The contact portion 942 is thus bent to have a curved portion, and is brought into contact with a power terminal of a battery unit, not shown, by making use of the spring force of the curved portion.

The bottom portion 941 is formed with solder connection portions 941*a* and 941*b* on a rear end and an intermediate portion thereof, respectively, each bent to curve upward (see FIGS. 11A, 11B, and 11C).

The solder connection portions 941*a* and 941*b* are joined to respective patterned lands 911 on the printed substrate 910 with solder 926 (see FIGS. 9 and 10).

However, when the solder connection portions 941*a* and 941*b* are joined to the patterned lands 911 on the printed substrate 910 with the solder 926, the solder 926 in a molten state sometimes flows in between the printed substrate 910 and the bottom portion 941 of each connector terminal 904, or sometimes reaches the contact portion 942 of each connector terminal 904.

As a result, the spring characteristics of each connector terminal 904 change, making unstable contact pressure generated between the contact portion 942 of each connector terminal 904 and the power terminal of the battery unit, which sometimes causes a contact failure.

SUMMARY OF THE INVENTION

The present invention has been made in view of these circumstances, and an object thereof is to provide a connector which is capable of preventing the spring characteristics of contacts from changing due to what is called "sucking up of solder".

To attain the above object, the present invention provides a connector comprising an insulating sheet, and a plurality of contacts connected to the insulating sheet, each including a contact portion which is brought into contact with a first object to be connected, a spring portion which is continuous with the contact portion, and a connection portion which is continuous with the spring portion and is soldered to a second object to be connected, the spring portion having a low wettability area formed on an end thereof toward the connection portion, to which solder is less likely to adhere.

Preferably, the insulating sheet is formed with openings, and the contact portion protrudes toward the first object to be connected, from each of the openings.

Preferably, the insulating sheet is formed with openings, and the contact portion is arranged within each of the openings.

Preferably, the insulating sheet is elastically deformed in a manner following elastic deformation of the contacts.

Preferably, the connection portion protrudes from an edge of the insulating sheet in a direction orthogonal to a direction of a thickness of the insulating sheet, and the contacts are arranged in two rows on the insulting sheet.

More preferably, the connection portion protrudes from the insulating sheet in the direction of the thickness of the insulating sheet.

According to this invention, it is possible to prevent the spring characteristics of the contacts from changing due to sucking up of solder.

The above and other objects, features and advantages of the present invention will become more apparent from the following detailed description taken in conjunction with the accompanying drawings.

BRIEF DESCRIPTION OF THE DRAWINGS

FIGS. 11A to 11C are views showing a connector terminal of the connector shown in FIG. 9, in which FIG. 11A is a plan view of the connector terminal, FIG. 11B is a side view of the same, and FIG. 11C is a bottom view of the same.

DETAILED DESCRIPTION OF THE PREFERRED EMBODIMENTS

The present invention will now be described in detail with reference to the drawings showing preferred embodiments thereof.

Figure 1:
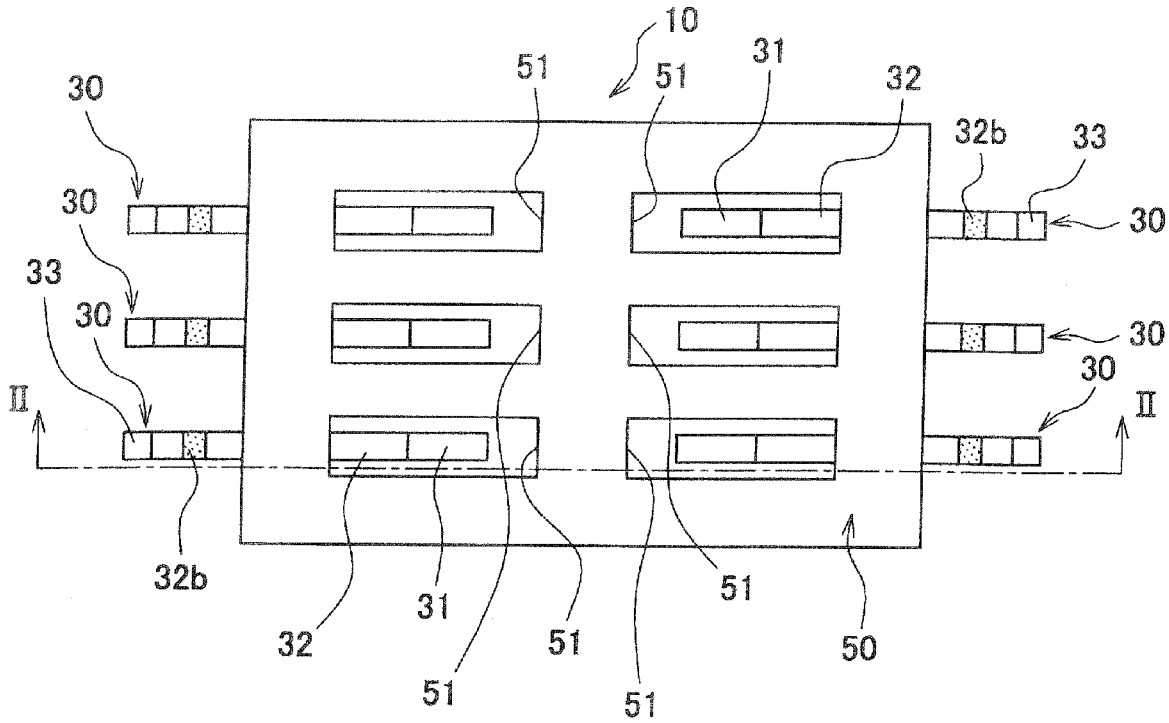
FIG. 1 is a plan view of a connector according to an embodiment of the present invention.

As shown in FIG. 1, a connector 10 comprises six contacts 30 and one insulating sheet 50 which connects the six contacts 30. The connector 10 is used e.g. in combination with a shell, not shown. The shell is mounted on a printed substrate (second object to be connected) 72 (see FIG. 5) to cover the connector 10. The connector 10 and the shell form a card-type connector, not shown. A card-type electronic component (first object to be connected), not shown, such as a SD card and a SIM card, is inserted into the shell.

Figure 3:
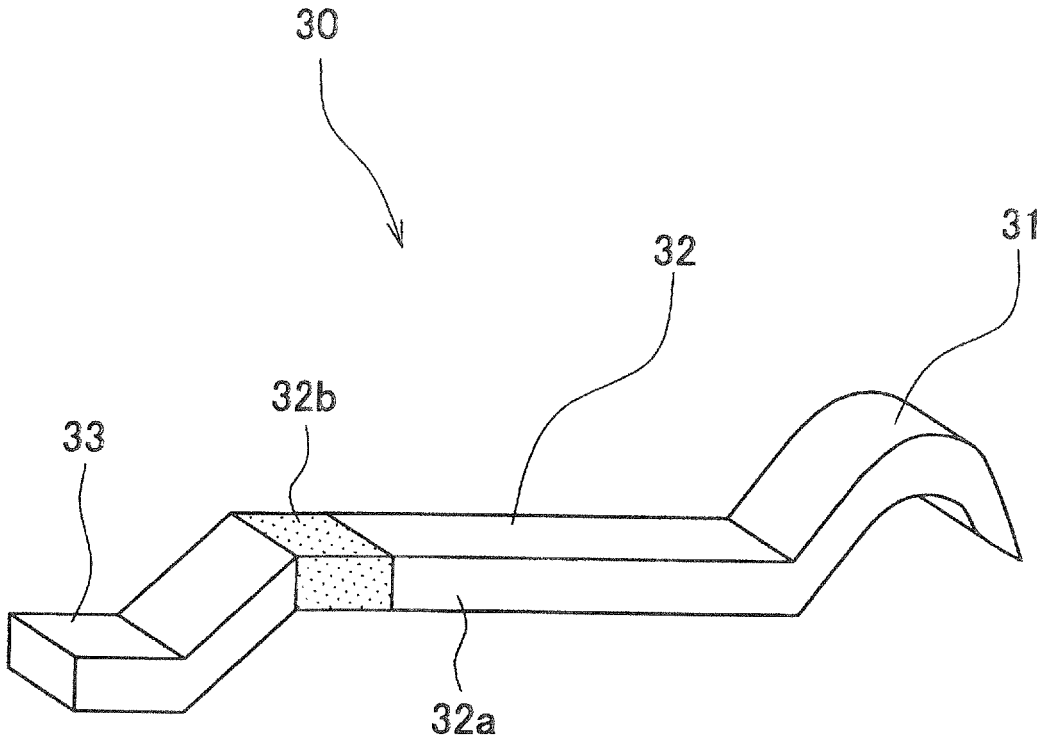
FIG. 3 is a perspective view of a contact of the connector shown in FIG. 1.
Figure 5:
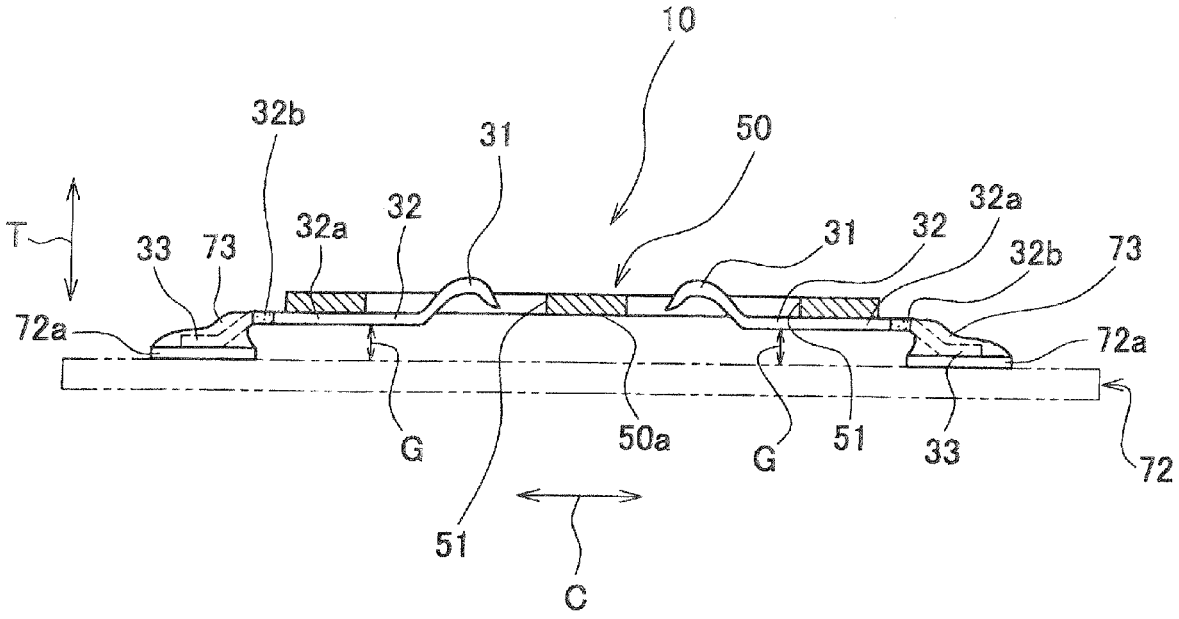
FIG. 5 is a cross-sectional view of the same part as shown in FIG. 2, in a state in which the connector shown in FIG. 1 is mounted on a printed substrate.

As shown in FIGS. 3 and 5, each contact 30 includes a contact portion 31, a spring portion 32, and a connection portion 33, and is formed by blanking and bending a metal plate. In the present embodiment, e.g. copper or copper alloy is used as a material of the metal plate. The surface of a contact material member (a metal plate in a state before being plated after being blanked and bent) is, for example, nickel-plated, and the surface of this nickel-plated layer is, for example, gold-plated in order to improve solder wettability.

The contact portion 31 is bent into an arc shape, and is brought into contact with an electrode (not shown) of a card-type electronic component.

The spring portion 32 is substantially plate-shaped, and is continuous with the contact portion 31. The spring portion 32 presses the contact portion 31 against the electrode of the card-type electronic component when the card-type electronic component and the printed substrate 72 are connected to each other.

The spring portion 32 has a fixing portion 32*a*. The fixing portion 32*a* is fixed to the insulating sheet 50. In the present embodiment, the fixing portion 32*a* is fixed to a lower surface 50*a* of the insulating sheet 50 with adhesive. The spring portion 32 has a low wettability area 32*b* formed on an end thereof toward the connection portion 33. The low wettability area 32*b* is an area to which a molten solder 73 (see FIG. 5) is less likely to adhere. The low wettability area 32*b* in the present embodiment is a nickel-plated layer which is exposed by eliminating part of the gold-plated layer. The low wettability area 32*b* has low wettability to solder.

The connection portion 33 is substantially L-shaped, and is continuous with the spring portion 32. The connection portion 33 is soldered to a pad 72*a* (see FIG. 5) of the printed substrate 72.

Figure 2:
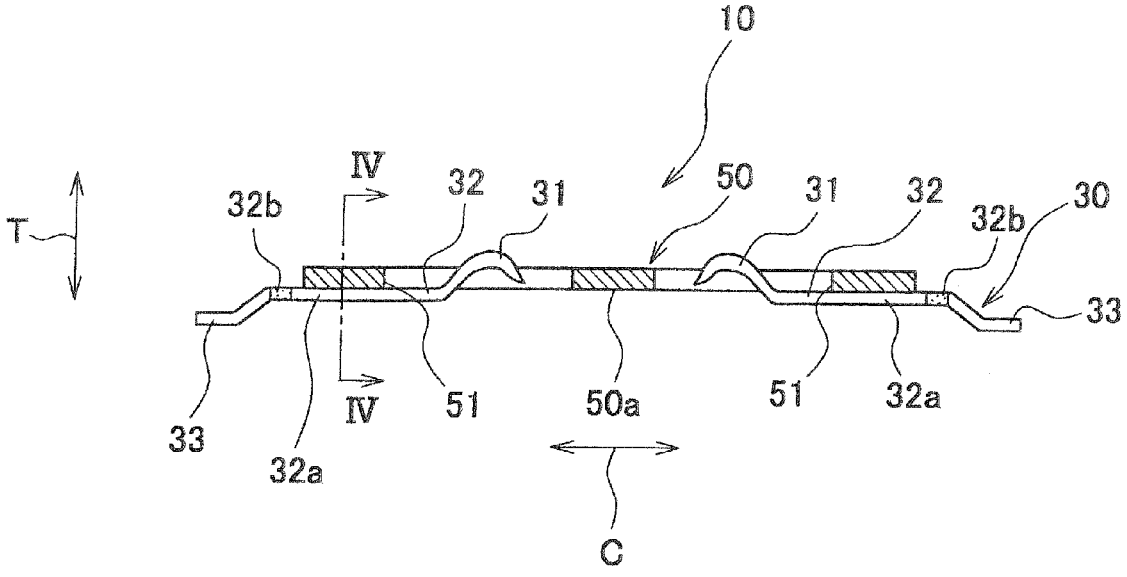
FIG. 2 is a cross-sectional view taken along of FIG. 1.

As shown in FIGS. 2 and 5, the connection portion 33 protrudes from the lower surface 50*a* of the insulating sheet 50 in a direction T of a thickness of the insulating sheet 50, and also protrudes from an edge of the insulating sheet 50 in a direction C orthogonal to the direction T of the thickness of the insulating sheet 50 (longitudinal direction of the insulating sheet 50 in the present embodiment). A gap G is formed between the spring portion 32 and the printed substrate 72.

The insulating sheet 50 is substantially rectangular (see FIG. 1). The insulating sheet 50 has elasticity, and is elastically deformed such that it can follow elastic deformation of the contacts 30 (see FIG. 6). In the present embodiment, e.g. liquid-crystal polymer is used as a material of the insulating sheet 50.

The insulating sheet 50 has six openings 51 formed therein (see FIG. 1). The six openings 51 are arranged in two rows in a lateral direction of the insulating sheet 50 (direction along the shorter sides of the rectangular insulating sheet 50). Each opening 51 is rectangular, and extends in a longitudinal direction of the insulating sheet 50 (direction along the longer sides of the rectangular insulating sheet 50). The contact portion 31 of each contact 30 protrudes upward from associated one of the openings 51 (see FIG. 2).

The six contacts 30 are arranged in two rows in the lateral direction of the insulating sheet 50. The longitudinal direction of the spring portion 32 of each contact 30 is parallel to the longitudinal direction of the insulating sheet 50 (see FIGS. 1 and 2).

Next, a description will be given of a procedure for manufacturing the connector 10.

First, a metal plate is blanked and bent to form a plurality of contact material members which are continuous to a carrier (not shown) in a state arranged in one row. The longitudinal direction of the contact material members continuous to the carrier is orthogonal to the longitudinal direction of the carrier.

Next, the plurality of contact material members are nickel-plated.

Then, the surface of the nickel-plated layer is gold-plated.

Next, laser light is irradiated to all periphery of the end of the spring portion 32 toward the connection portion 33 to thereby remove the gold plate from this portion (end). As a result, the nickel-plated layer is exposed on the end of the spring portion 32 toward the connection portion 33, whereby the low wettability area 32*b* is formed.

Then, the plurality of contacts 30 continuous to the carrier is divided into groups each of which is formed by one carrier and three contacts 30 which are continuous to the one carrier. After dividing the contacts, the six contacts 30 are arranged in two rows such that the carriers of the two groups are side by side and parallel to each other, and this state is maintained by a jig (not shown). At this time, the contact portions 31 of the contacts 30 of one group and the contact portions 31 of the contacts 30 of the other group are disposed adjacent to each other with a predetermined spacing therebetween in the longitudinal direction of the insulating sheet 50.

Next, the adhesive is applied to the fixing portion 32*a* of the spring portion 32 of each contact 30, and the insulating sheet 50 is placed over the contacts 30 from above the contacts 30. At this time, the insulating sheet 50 is placed over the contacts 30 such that the contact portions 31 of the contacts 30 are positioned in the openings 51 of the insulating sheet 50, respectively. As a result, the fixing portions 32*a* are adhered to the insulating sheet 50, and the contact portions 31 of the contacts 30 protrude upward from the associated openings 51 of the insulating sheet 50, respectively.

Finally, the carriers are removed from the contacts 30, respectively.

Following the above-described procedure, the connector 10 is completed.

Next, a description will be given of a procedure for connecting a card-type electronic component and the printed substrate 72 using the connector 10.

To connect a card-type electronic component and the printed substrate 72, the card-type connector is completed in advance by assembling the connector 10 to the shell, not shown, such that the connector 10 is held by the shell.

Next, the solder 73 is applied to the pad 72*a* on the printed substrate 72 in a paste form.

Then, the shell holding the connector 10 is disposed on the printed substrate 72. At this time, the contact portions 33 of the respective contacts 30 are placed on the pads 72*a* on the printed substrate 72.

Next, the printed substrate 72 and the card-type connector are put into a reflow furnace (not shown) to solder the contact portions 33 of the respective contacts 30 to the pads 72*a* on the printed substrate 72, and solder the shell to the printed substrate 72.

At this time, although the molten solder 73 would attempt to flow along the connection portion 33 up to the spring portion 32, since the low wettability area 32*b* is less likely to be wet by the solder 73, the flowing speed of the solder 73 up to the spring portion 32 is reduced, which results in suppression of the sucking up of the solder 73 to the spring portion 32 (see FIG. 5).

To connect the card-type electronic component and the printed substrate 72, it is only required to insert the card-type electronic component into the shell from an opening (not shown) formed in a side of the shell.

Figure 6:
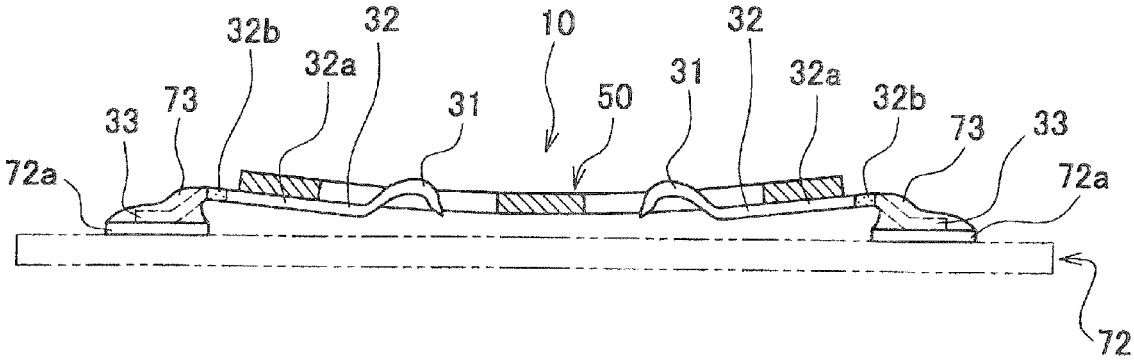
FIG. 6 is a cross-sectional view showing a state in which the connector shown in FIG. 5 is elastically deformed.

When the card-type electronic component is inserted into the shell, as shown in FIG. 6, the spring portion 32 of each contact 30 is elastically deformed, and the contact portion 31 of each contact 30 is pressed against associated electrodes of the card-type electronic component by a spring force of the spring portion 32 to return to its original shape. As a result, the card-type electronic component and the printed substrate 72 are electrically connected via the contacts 30. Further, in the present embodiment, since the insulating sheet 50 is elastically deformed such that it follows the elastic deformation of the contacts 30 (see FIG. 6), the contact portion 31 of each contact 30 is pressed against the associated electrode of the card-type electronic component also by a spring force of the insulating sheet 50 to return to its original shape. Therefore, the contact portion 31 is more positively brought into contact with the associated electrode of the card-type electronic component.

According to the present embodiment, the low wettability area 32*b* prevents the solder 73 from flowing from the connection portion 33 up to the spring portion 32, and hence it is possible to prevent the spring characteristics of each contact 30 from changing.

Further, since the plurality of contacts 30 are connected by adhering the insulating sheet 50 only to the upper surface of the fixing portion 32*a* of the spring portion 32, it is possible to realize the connector having a smaller height than that of a connector of a type which connects the plurality of contacts 30 by adhering the insulating sheets 50 to the upper surface and the lower surface of the fixing portion 32*a* of the spring portion 32, respectively (i.e. a connector, not shown, of a type which sandwiches the contacts between the two insulating sheets).

Figure 9:
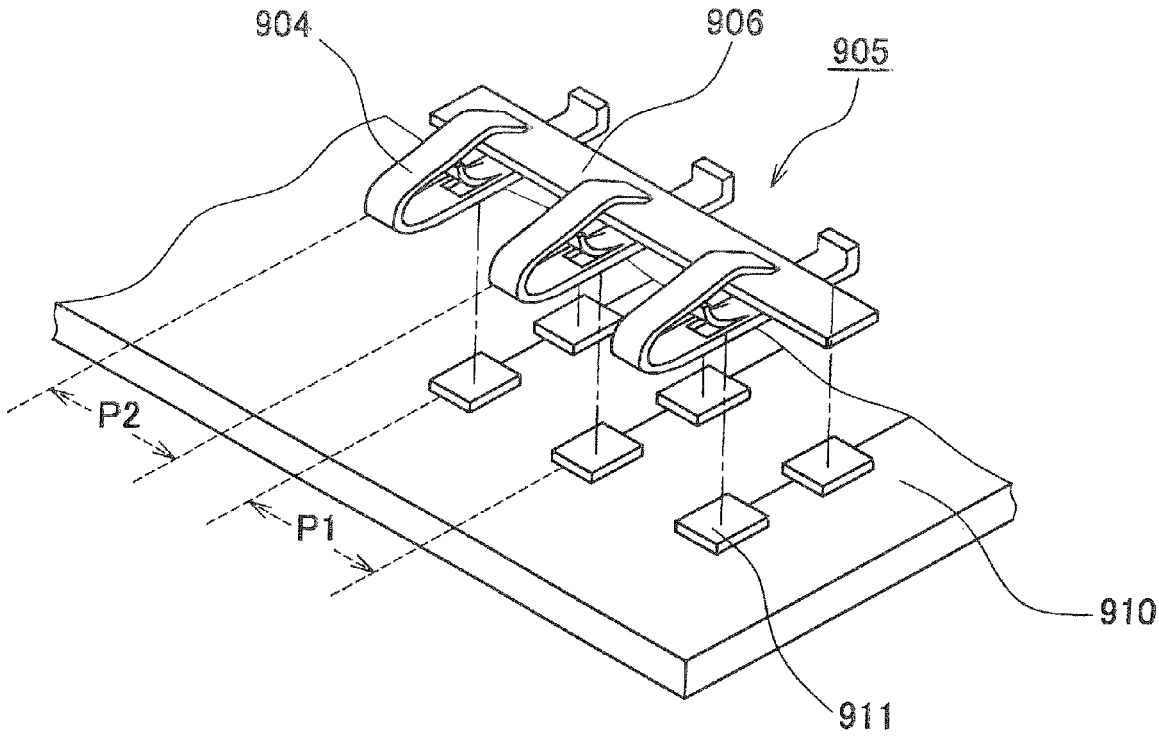
FIG. 9 is a perspective view showing a state before a conventional connector is mounted on a printed wiring board.
Figure 10:
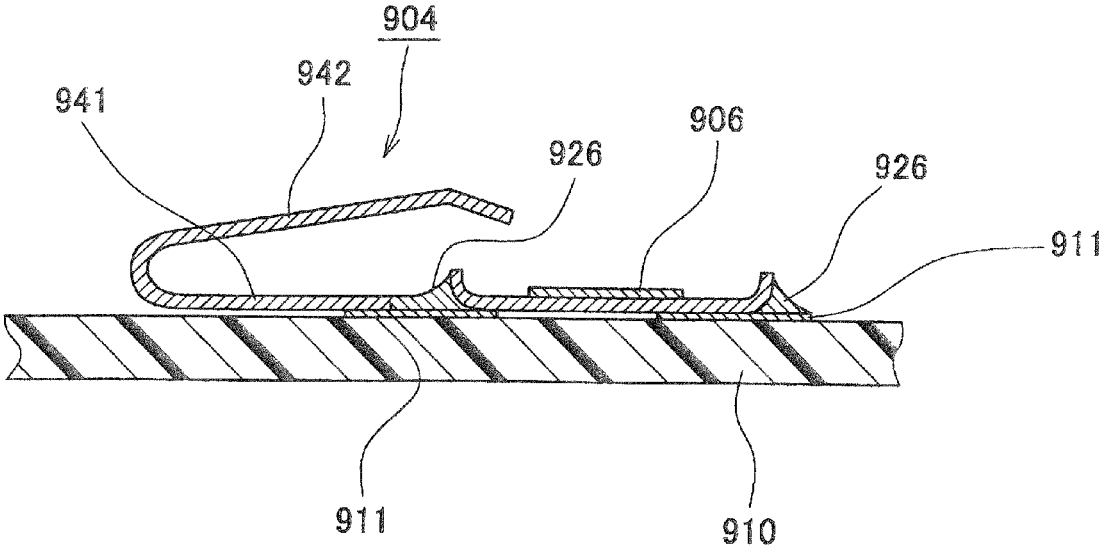
FIG. 10 is a cross-sectional view showing a state in which the connector shown in FIG. 9 has been mounted on the printed wiring board.

Note that in the conventional electric connector, to reduce a pitch P1 of the patterned lands 911 (see FIG. 9), if the width of each patterned land 911 in a direction of the pitch P1 is reduced, it is necessary, according to the reduction of the pitch P1, to reduce a pitch P2 (see FIG. 9) of the connector terminals 904 by reducing the width of each connector terminal 904 in a direction of the pitch thereof.

Figure 11A:
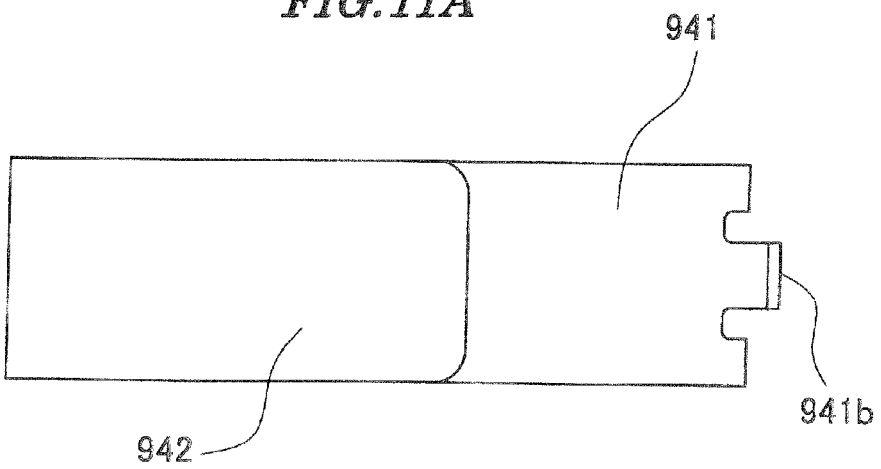
Figure 11B:
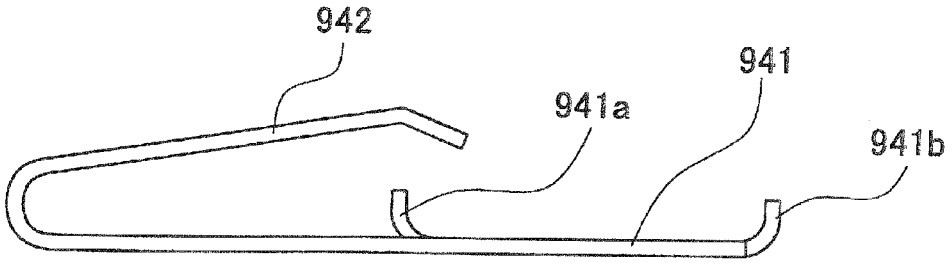
Figure 11C:
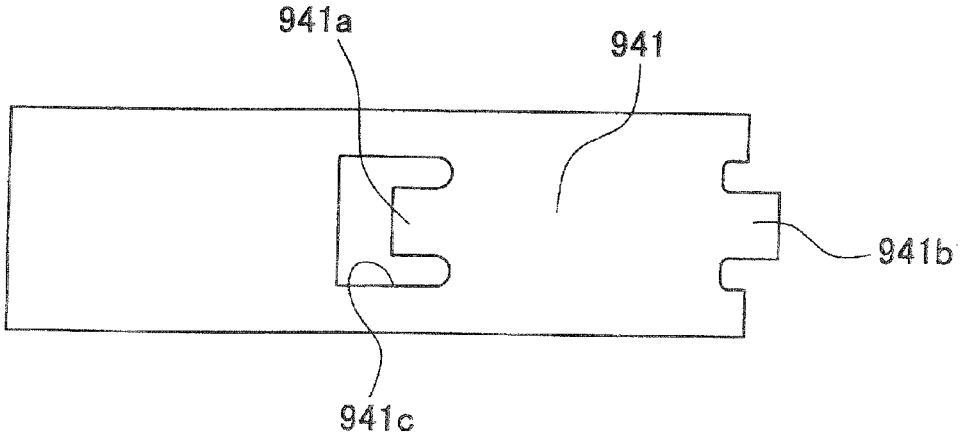

However, a large hole 941*c* for soldering is formed (see FIG. 11C) around the solder connection portion 941*a* as mentioned hereinabove. Therefore, because of this structure, it is required to increase the width of the bottom portion 941 in the direction of the pitch. This results in an increase in the width of the connector terminal 904 in the direction of the pitch.

Therefore, the connector terminals 904 cannot adapt to reduction of the pitch of the patterned lands 911. In contrast, the contacts 30 each do not have the hole 941*c* for soldering, and hence the contacts 30 can adapt to reduction of the pitch of the pads 72*a* on the printed substrate 72.

Figure 7:
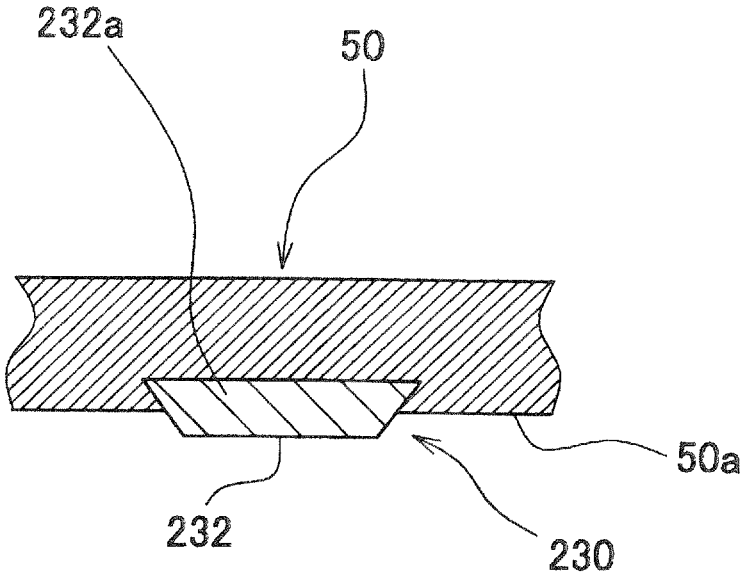
FIG. 7 is a cross-sectional view of the same part as shown in FIG. 4, showing a first variation of the embodiment shown in FIG. 1.

Next, a description will be given of a first variation of the above-described embodiment with reference to FIG. 7. Component parts identical to those of the connector according to the above-described embodiment are designated by identical reference numerals, and detailed description thereof is omitted, while only main component parts different in construction from those of the above-described embodiment will be described hereinafter.

Figure 4:
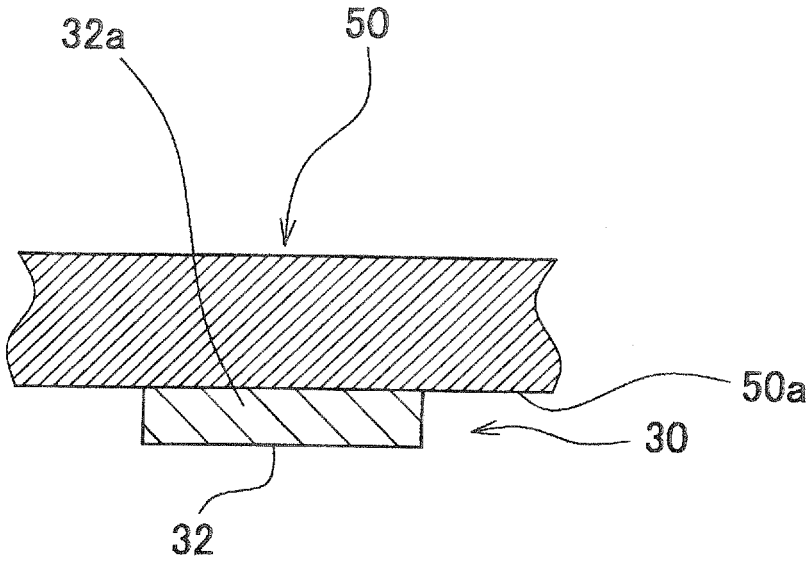
FIG. 4 is a cross-sectional view taken along IV-IV of FIG. 2.

In the above-described embodiment, as shown in FIG. 4, the spring portion 32 of each contact 30 is rectangular in cross-section, and the upper surface of the fixing portion 32*a* of the spring portion 32 is adhered to the lower surface 50*a* of the insulating sheet 50. In contrast, in the first variation, a spring portion 232 of each contact 230 is trapezoidal in cross-section with an upper side longer than a lower side, and has an upper half of a fixing portion 232*a* thereof embedded in the insulating sheet 50.

To embed the upper half of the fixing portion 232*a* of the spring portion 232 of each contact 230 in the insulating sheet 50 as mentioned above, it is only required to place the insulating sheet 50 on the upper surface of the fixing portion 232*a* of the spring portion 232 of each contact 230, then heat each contact 230 e.g. by a heater disposed on a head (pressing portion) of a pressing machine (not shown), and press the insulating sheet 50 against each contact 230 by the pressing machine.

According to the first variation, it is possible to obtain the same advantageous effect as provided by the first embodiment, and it is possible to further reduce the connector in height.

Figure 8:
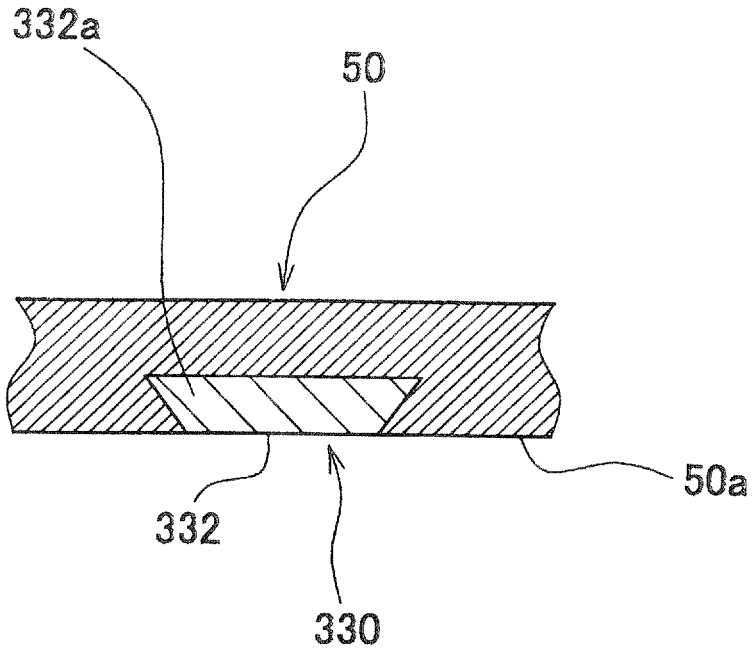
FIG. 8 is a cross-sectional view of the same part as shown in FIG. 4, showing a second variation of the embodiment shown in FIG. 1.

Next, a description will be given of a second variation of the above-described embodiment with reference to FIG. 8. Component parts identical to those of the connector according to the above-described embodiment are designated by identical reference numerals, and detailed description thereof is omitted, while only main component parts different in construction from those of the above-described embodiment will be described hereinafter.

Although in the first variation, the upper half of the fixing portion 232*a* of the spring portion 232 of each contact 230 is embedded in the insulating sheet 50, in the second variation, an entire fixing portion 332*a* of a spring portion 332 of each contact 330 is embedded in the insulating sheet 50, so that the lower surface of the fixing portion 232*a* is flush with the lower surface 50*a* of the insulating sheet 50. The method of embedding the contacts 330 in the insulating sheet 50 is the same as that used in the first variation.

According to the second variation, it is possible to obtain the same advantageous effect as provided by the first embodiment, and it is possible to furthermore reduce the connector in height.

Although in the above-described embodiment, the nickel-plated layer (primary plating layer) on the low wettability area 32*b*, having low wettability, is exposed by laser treatment, the low wettability area 32*b* may be formed by a treatment method other than the laser treatment. For example, after nickel-plating the contact material member, part of the nickel-plated layer (the end of the spring portion 32 toward the connection portion 33) may be covered with a mask, and then the surface of the nickel-plated layer may be gold-plated. Finally, by removing the mask, the nickel-plated layer is partially exposed, whereby the low wettability area 32*b* is formed on the end of the spring portion 32 toward the connection portion 33.

Further, although in the above-described embodiment, the connection portion 33 of each contact 30 protrudes from the edge of the insulating sheet 50 in the direction C orthogonal to the direction T of the thickness of the insulating sheet 50, it is not necessarily required to configure each contact 30 as mentioned above.

Although in the above-described embodiment, the contact portion 31 of each contact 30 is protruded from the associated one of the openings 51 of the insulating sheet 50, it is not necessarily required to protrude the contact portion 31 from the associated one of the openings 51. Assuming, for example, that the electrode of the card-type electronic component protrudes, the contact portion may be disposed within each opening 51 such that the contact portion 31 does not protrude from the surface of the insulating sheet 50 toward the card-type electronic component.

Further, although in the above-described embodiment, the insulating sheet 50 is elastically deformed such that it follows the elastic deformation of the contacts 30, the insulating sheet 50 is not required to be elastically deformed.

Although in the above-described embodiment, the contacts 30 are arranged in two rows, the contacts 30 may be arranged e.g. in one row, three rows, or four rows.

Further, although in the above-described embodiment, the connection portion 33 of each contact 30 is substantially L-shaped, and is soldered to one pad 72*a* on the printed substrate 72, the shape of the connection portion is not limited to the L-shape. For example, the connection portion may have a bifurcated shape, and may be soldered to two pads on the printed substrate.

Further, although in the above-described embodiment, the insulating sheet 50 is fixed to the fixing portion 32*a* of the spring portion 32 of each contact 30, a location or a position to fix the insulating sheet 50 is not limited to the spring portion 32 of each contact 30. For example, the insulating sheet may be fixed to part of the connection portion of the contact (part which does not interfere with soldering).

It is further understood by those skilled in the art that the foregoing are the preferred embodiments of the present invention, and that various changes and modification may be made thereto without departing from the spirit and scope thereof.

What is claimed is:

1. A connector comprising:

an insulating sheet; and a plurality of contacts connected to said insulating sheet, each of the contacts including a contact portion which is configured to be brought into contact with a first object to be connected, a spring portion which is continuous with said contact portion, and a connection portion which is continuous with said spring portion and is configured to be soldered to a second object to be connected, wherein said spring portion has a low wettability area formed on an end thereof toward said connection portion, to which solder is less likely to adhere, wherein said low wettability area is positioned above said connection portion and protrudes from an edge of said insulating sheet in a direction orthogonal to a direction of a thickness of said insulating sheet, and wherein the end of said spring portion toward said connection portion has an inclined part between said low wettability area and said connection portion.

2. The connector as claimed in claim 1, wherein said insulating sheet is formed with openings, and said contacts are arranged such that said contact portions thereof protrude toward the first object to be connected, from the openings, respectively.

3. The connector as claimed in claim 2, wherein said insulating sheet is configured to be elastically deformed in a manner following elastic deformation of said contacts.

4. The connector as claimed in claim 3, wherein said connection portion protrudes from an edge of said insulating sheet in the direction orthogonal to the direction of the thickness of said insulating sheet, and wherein said contacts are arranged in two rows on said insulting sheet.

5. The connector as claimed in claim 4, wherein said connection portion protrudes from said insulating sheet in the direction of the thickness of said insulating sheet.

6. The connector as claimed in claim 2, wherein said connection portion protrudes from an edge of said insulating sheet in the direction orthogonal to the direction of the thickness of said insulating sheet, and wherein said contacts are arranged in two rows on said insulting sheet.

7. The connector as claimed in claim 6, wherein said connection portion protrudes from said insulating sheet in the direction of the thickness of said insulating sheet.

8. The connector as claimed in claim 1, wherein said insulating sheet is formed with openings, and said contacts are arranged such that said contact portions thereof are arranged within the openings, respectively.

9. The connector as claimed in claim 8, wherein said insulating sheet is configured to be elastically deformed in a manner following elastic deformation of said contacts.

10. The connector as claimed in claim 9, wherein said connection portion protrudes from an edge of said insulating sheet in the direction orthogonal to the direction of the thickness of said insulating sheet, and wherein said contacts are arranged in two rows on said insulting sheet.

11. The connector as claimed in claim 10, wherein said connection portion protrudes from said insulating sheet in the direction of the thickness of said insulating sheet.

12. The connector as claimed in claim 8, wherein said connection portion protrudes from an edge of said insulating sheet in the direction orthogonal to the direction of the thickness of said insulating sheet, and wherein said contacts are arranged in two rows on said insulting sheet.

13. The connector as claimed in claim 12, wherein said connection portion protrudes from said insulating sheet in the direction of the thickness of said insulating sheet.

14. The connector as claimed in claim 1, wherein said insulating sheet is configured to be elastically deformed in a manner following elastic deformation of said contacts.

15. The connector as claimed in claim 14, wherein said connection portion protrudes from an edge of said insulating sheet in the direction orthogonal to the direction of the thickness of said insulating sheet, and wherein said contacts are arranged in two rows on said insulting sheet.

16. The connector as claimed in claim 15, wherein said connection portion protrudes from said insulating sheet in the direction of the thickness of said insulating sheet.

17. The connector as claimed in claim 1, wherein said connection portion protrudes from an edge of said insulating sheet in the direction orthogonal to the direction of the thickness of said insulating sheet, and wherein said contacts are arranged in two rows on said insulting sheet.

18. The connector as claimed in claim 17, wherein said connection portion protrudes from said insulating sheet in the direction of the thickness of said insulating sheet.

* * * * *

UNITED STATES PATENT AND TRADEMARK OFFICE

CERTIFICATE OF CORRECTION

PATENT NO. : 8,727,810 B2
APPLICATION NO. : 13/534434
DATED : May 20, 2014
INVENTOR(S) : Takushi Yoshida et al.

It is certified that error appears in the above-identified patent and that said Letters Patent is hereby corrected as shown below:

In the Specification

Column 2 line 25, (under BRIEF DESCRIPTION OF THE DRAWINGS):

delete “along” and insert --along II-II--.

Signed and Sealed this
Fourteenth Day of October, 2014

Michelle K. Lee

Michelle K. Lee
*Deputy Director of the United States Patent and Trademark Office*